United States Patent [19]

Forrester

[11] Patent Number: 4,747,318

[45] Date of Patent: May 31, 1988

[54] DRIVE FOR A MACHINE GUN

[75] Inventor: Victor J. Forrester, Burlington, Vt.

[73] Assignee: General Electric Company, Burlington, Vt.

[21] Appl. No.: 29,494

[22] Filed: Mar. 23, 1987

Related U.S. Application Data

[62] Division of Ser. No. 878,470, Dec. 18, 1985.

[51] Int. Cl.[4] ..... F16M 21/40

[52] U.S. Cl. ..... 74/25; 74/70

[58] Field of Search ..... 74/25, 70, 318–324, 74/404

[56] References Cited

U.S. PATENT DOCUMENTS

| | | | |
|---|---|---|---|
| 430,206 | 6/1890 | Garland | 89/9 |
| 1,571,653 | 2/1926 | Textorius | 74/70 |
| 2,748,611 | 6/1956 | Cusson | 74/70 |
| 3,869,935 | 3/1975 | Mathieu | 74/70 |

FOREIGN PATENT DOCUMENTS

| | | | |
|---|---|---|---|
| 626349 | 8/1961 | Canada | 74/25 |
| 980677 | 1/1965 | United Kingdom | 74/25 |
| 765574 | 9/1980 | U.S.S.R. | 74/404 |
| 821823 | 4/1981 | U.S.S.R. | 74/25 |
| 1165834 | 7/1985 | U.S.S.R. | 70/ |

OTHER PUBLICATIONS

Chironis, *Mechanisms, Linkages & Mechanical Controls*, McGraw-Hill (New York), 1965, p. 90.

*Primary Examiner*—Lawrence J. Staab
*Attorney, Agent, or Firm*—Bailin L. Kuch

[57] ABSTRACT

This invention provides the provision of a motor, whose output shaft is fixed to a pinion gear, meshed with two mutually opposed driven pinion gears, each carrying a respective cam roller, which alternatively enter and exit a cam surface on a cam follower, which is fixed to a second shaft, to oscillate said follower and said second shaft, and a first sector gear which is fixed to said second shaft and meshed with a second gear, which is axially fixed to the rocking lever in the drive linkage of a machine gun. Alternatively, the first sector gear is meshed with a second sector gear formed on the rocking lever.

4 Claims, 4 Drawing Sheets

DRIVE FOR A MACHINE GUN

This is a divisional of co-pending application Ser. No. 878,470, filed on 12/18/85.

RELATED CASE

This application discloses and claims an external drive particularly suitable for a machine gun of the type shown in copending application Ser. No. 793,013, filed Oct. 30, 1985, and is an improvement of the external drive shown therein. The disclosure of that application is hereby incorporated by reference, and reference may be made to that application for details of the machine gun which are not explicitly set out in this application. The drive, however, is suitable for use with other machine guns.

BACKGROUND OF THE INVENTION

1. Field of the Invention

This application relates to an external drive for machine guns having two gun barrels and a linkage which alternatively drives each breech bolt.

2. Description of the Prior Art

A two barreled machine gun having an operating mechanism driven by an external source is shown in U.S. Pat. No. 430,206, issued June 17, 1890 to F. M. Garland. In this gun a hand crank or a motor rotates a shaft to rotate two 180° out of phase cams, which cams respectively oscillate two levers, which levers reciprocate respective loading and firing bolts.

SUMMARY OF THE INVENTION

It is an object of this invention to provide a compact external drive providing a large angular oscillation to a rocking lever in the drive linkage of a machine gun.

A feature of this invention is the provision of a motor, whose output shaft is fixed to a pinion gear, meshed with two mutually opposed driven pinion gears, each carrying a respective cam roller, which alternatively enter and exit a cam surface of a cam follower, which is fixed to a second shaft, to oscillate said follower and said second shaft, and a first sector gear which is fixed to said second shaft and meshed with a second sector gear, which is axially fixed to the rocking lever in the drive linkage of a machine gun. Alternatively, the first sector gear is meshed with a second sector gear formed on the rocking lever.

BRIEF DESCRIPTION OF THE DRAWING

These and other objects, features and advantages of the invention will become apparent from the following specification thereof taken in conjunction with the accompanying drawing in which.

DESCRIPTION OF THE INVENTION

Figure 1:
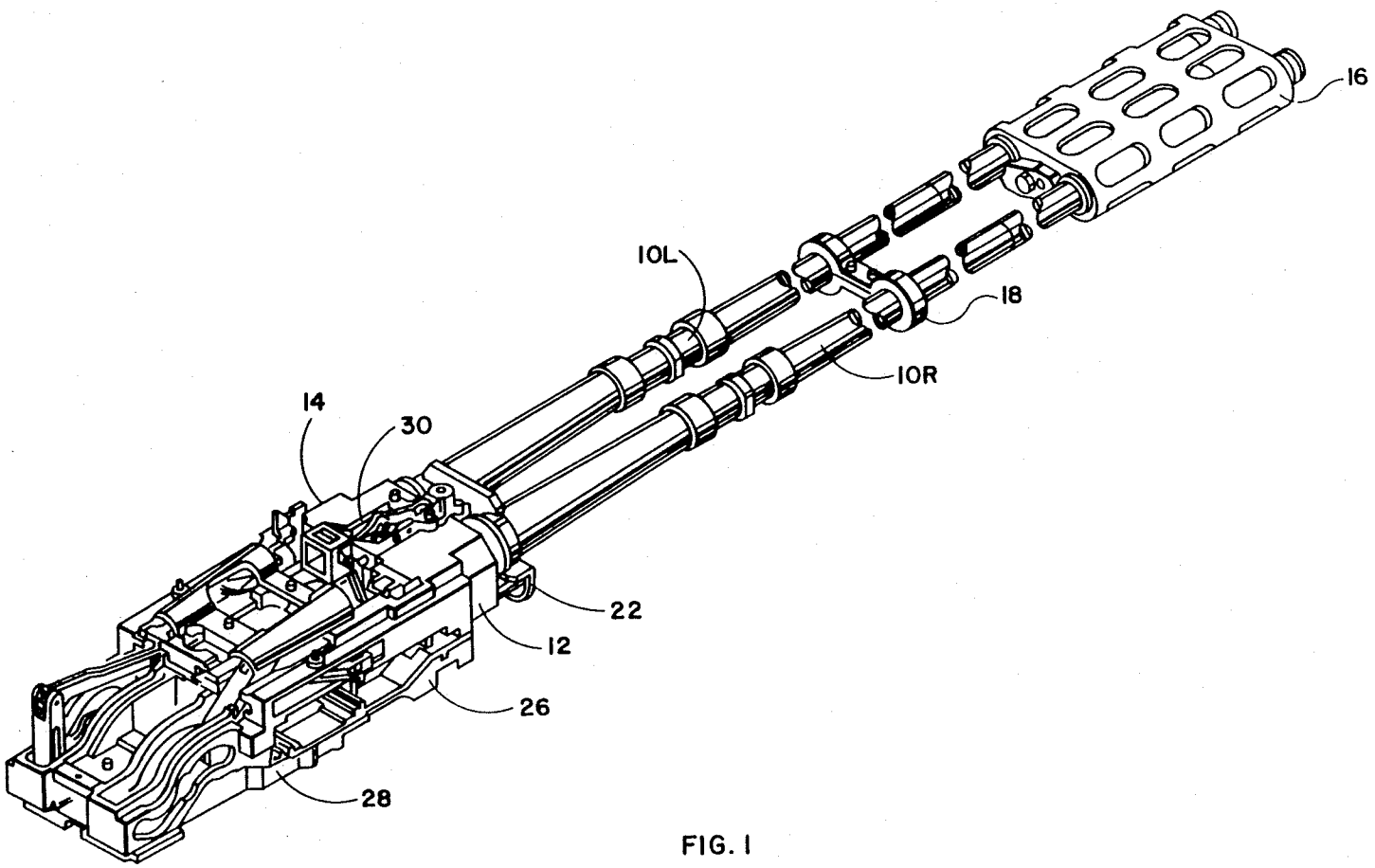
FIG. 1 is a perspective view of a gun embodying this invention of the type shown in Ser. No. 793,013.

As seen in FIG. 1, the gun includes a left hand gun barrel 10L and a right hand gun barrel 10R which are secured to a breech housing 12 of a breech assembly 14. The barrels are also constrained by a muzzle clamp assembly 16, a mid-barrel clamp assembly 18, and an aft clamp assembly 22. The breech housing 12 is fixed to a receiver housing 26 in a receiver assembly 28. A hammer assembly 30 is also fixed to the breech housing 12. The breech and receiver housings may be considered together to be the classical "receiver."

Figure 2:
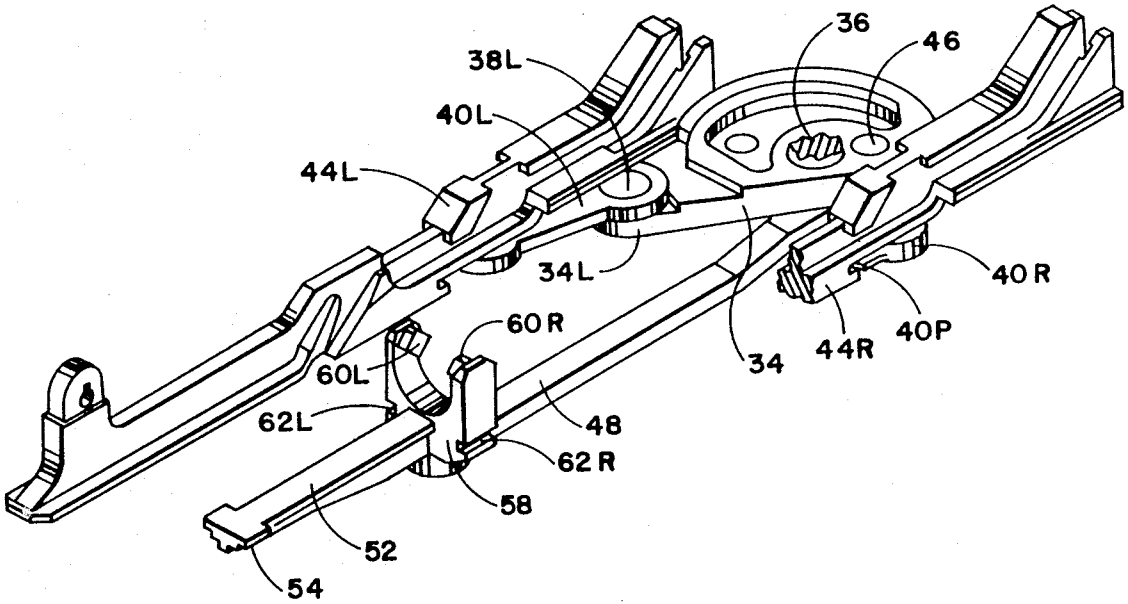
FIG. 2 is a detail of FIG. 1 showing the operating linkages contained in the receiver assembly of the gun of FIG. 1.

As seen in FIG. 2, the operating mechanism is mainly disposed within the receiver housing 26 and is included in the receiver assembly 28. This operating mechanism includes a rocking lever 34 which is fixed to a central post 36, and which post is journaled for oscillation to the receiver housing 26. The rocking lever 34 has a left arm 34L to which is fixed a left post 38L which is journaled to the forward end of a left link 40L, and has a right arm (not visible) to which is fixed a right post (not visible) which is journaled to the forward end of a right link 40R. The aft end of the left link 40L is journaled to a left post which is fixed to a left slider 44L. The aft end of the right link 40R is journaled to a right post (not visible) which is fixed to a right slider 44R which is identical to the left slider 44L. The aft end of each link 40L/R has a projection 40P which is captured in a respective notch in the respective slider 44L/R to capture the link to its respective post 42L/R. An additional post 46 is fixed to the rocking lever 34 and is journaled to the forward end of a feeder arm 48. The aft end of the feeder arm 48 has a post (not visible) to which is pivotally journaled a tail slider 52. The aft end of the slider has a cross-piece 54 which rides in a channel in the receiver housing 26. The forward end of the slider 52 has a cam driver 58 with two mutually spaced apart upstanding arms which terminate in mutually opposed cam driving elements 60L and 60R. The cam driver 58 also has a pair of slots 62L and 62R which ride on a pair of tracks in the receiver housing. The cam driver 58 is thereby constrained to rectilinear reciprocating movement when driven by the feeder arm 48 whose forward end is free to oscillate laterally while reciprocated fore and aft by the rocking lever 34. The cam driver drives (not shown here) a drum cam which in turn drives a feed sprocket to advance a belt of linked ammunition transversely through the gun. Each full cycle of oscillation of the rocking lever 34 results in the sprocket advancing the belt of ammunition by two rounds.

The aft ends of the two sliders 44L/R are respectively coupled to two accelerator arms which in turn are respectively coupled to two bolt assemblies. Each full cycle of oscillation of the rocking lever 34 results in the fore and aft reciprocation of both bolt assemblies to chamber and fire a total of two rounds of ammunition.

Each of the two sliders also cooperates (not shown here) with a respective set of front and rear strippers which serve to strip a round of ammunition from the belt and to place the round on the face of the bolt assembly, and to lock the bolt assembly when the round is chambered.

Figure 3:
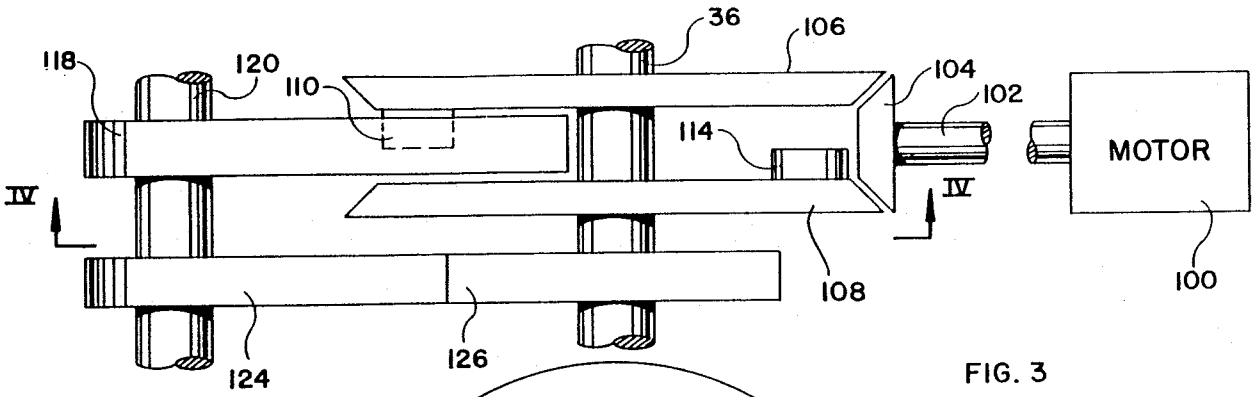
FIG. 3 is a side view of an external drive embodying this invention and having an oscillating input coupled to the operating linkages of FIG. 2.
Figure 4:
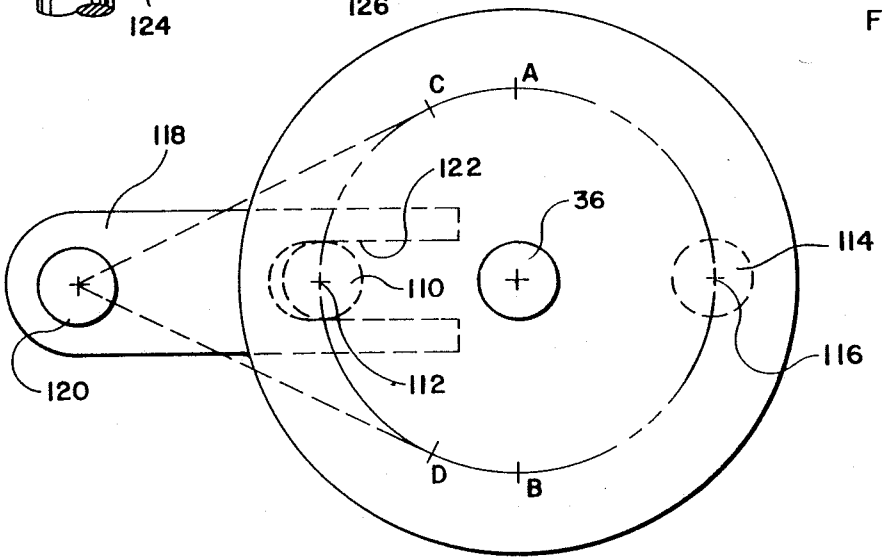
FIG. 4 is a plan view in cross-section taken along the plane IV—IV.

As seen in FIGS. 3 and 4, the external drive assembly includes an electric motor 100, whose output shaft 102 is fixed to a pinion bevel gear 104. The gear 104 is meshed with an upper bevel gear 106 and a lower bevel gear 108 which are both respectively journaled for rotation on the post 36. The post 36 is journaled for rotation to the receiver and is fixed to the rocking lever 34 (shown in FIG. 2). An upper cam roller or driver 110 is journaled for rotation on a stub shaft 112 which is carried by the upper gear 106. A lower cam roller or driver 114 is journaled for rotation on a stub shaft 116 which is carried by the lower gear 108. A bifurcated cam follower 118 is fixed to a shaft 120 which is journaled for oscillation to the receiver. The bifurcation projects between the gears 106 and 108 so that the rollers 110 and 114 may ride into and out of the cleft cam following surface 122 of the bifurcation. A sector gear 124 is fixed to the shaft 120 and meshed with a sector gear 126 which is fixed to the post 36. The shafts 102 and 120, and the post 36 are each respectively supported by stationary journals.

The two gears 106 and 108 are driven in opposite directions by the single pinion 104. One roller enters the cleft cam following surface 122 at point C or D, rotating the cam 118 in one direction through an arc less than 360°, and exiting the surface 122 at point D or C. There is a dwell period as the rollers pass by each other at points A or B. Then the other roller enters the surface at point D or C, rotating the cam 118 in the other direction and exiting the surface 122 at point C or D. This process continues, resulting in a uniform oscillation at the output shaft 120 of the cam. This oscillation is communicated to the sector gear 124 and thereby to the sector gear 126 and the post 36 and the rocking lever 34.

This system provides a relatively compact size, high mechanical advantage, and the ability to vary the magnitude of the output oscillation by varying the drive geometry of gearing the output up or down. The drive rollers enter and leave the cam path tangentially, giving a uniform acceleration and deceleration. The roller force is always perpendicular to the cam path giving an optimum mechanical advantage throughout the stroke, with a theoretically infinite mechanical advantage at the start and stop of the stroke. Thus, the mechanical advantage is highest where the most work needs to be done, which is the extraction of the fired case by the bolt and the acceleration of the bolt towards chambering the next round. There is a distinct dwell period between each stroke which allows time for a decay in gas pressure in the chamber before the unlocking of the breech.

Figure 5:
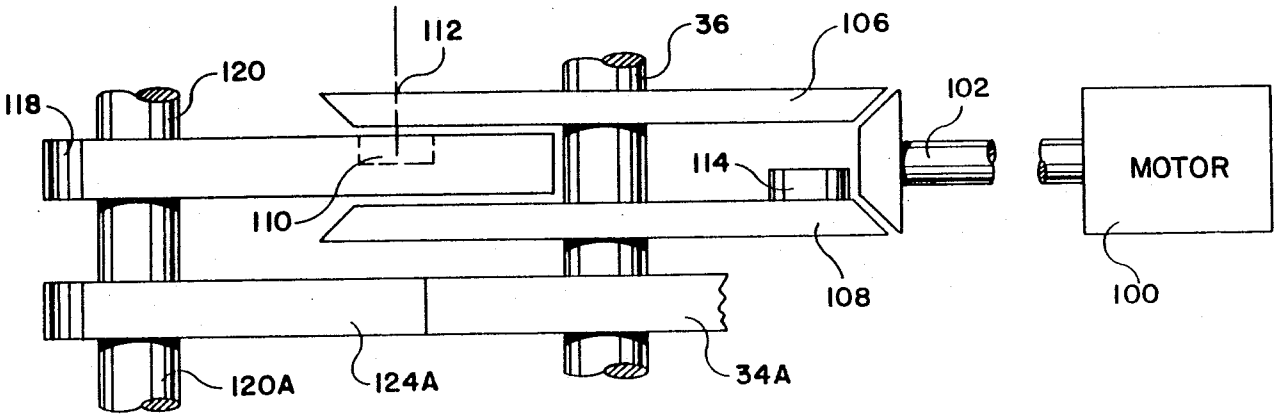
FIG. 5 is a side view of an alternative version of the external drive of FIG. 3.

Alternatively, as shown in FIG. 5, the post 36 may be fixed to the receiver and the rocking lever 34A may be journaled for oscillation on the post. In this case the equivalent of the sector 126 may be formed integrally with the rocking lever 34A, and the sector 124A which is fixed on the shaft 120A will mesh directly with the rocking lever 34A. Both the rocking lever 34A and the sector gear 124A may be disposed within the receiver.

I claim:

1. An external drive means, for a gun having a operating mechanism including a rocking lever journalled for oscillation about a central axis, comprising:

a motor having an output shaft which is coupled, through as oscillatory drive mechanism having less than 360° of rotation, to said rocking lever;

said drive mechanism including:

a pinion gear coupled to and driven by said motor;

said pinion gear meshed with and driving first and second mutually opposed gears, respectively journalled for rotation about a common first axis, in opposite directions of rotation;

a cam follower journalled for oscillation about a second axis, which second axis is parallel to and spaced from said first axis, to and between two angularly spaced apart dispositions through an arc which is less than 360°, and having a cleft cam surface disposed between said first and second opposed gears;

a first cam driver carried by said first opposed gear;

a second cam driver carried by said second opposed gear;

said first cam driver, as said first opposed gear is driven by said pinion, entering said cleft cam surface at one of said dispositions and swinging said cam follower to the other of said dispositions and exiting said cleft cam surface;

said second cam driver, as said second opposed gear is driven by said pinion, entering said cleft cam surface at said other of said dispositions and swinging said cam follower to said one of said dispositions and exiting said cleft cam surface.

2. A drive means according to claim 1 wherein:

said cam follower is fixed to a shaft, which is journalled for oscillation on said second axis, and which shaft is fixed to an intermediate gear which is meshed with an output gear, and which output gear is journalled for oscillation about said central axis of said rocking lever and connected to said rocking lever;

said drive means having a mode of operation such that continuous rotation of said motor provides rotation of said first and second cam drivers in respective opposite directions, one of said cam drivers swinging said cam follower in one direction and the other of said cam drivers swinging said cam follower in the other direction, and such alternating swinging providing oscillation of said rocking lever.

3. A drive means according to claim 2 wherein:

said output gear is connected to said rocking lever by a common shaft fixed to both.

4. A drive means according to claim 2 wherein:

said output gear is integral with said rocking lever.

* * * * *